US006490981B2

(12) United States Patent
Isensee et al.

(10) Patent No.: US 6,490,981 B2
(45) Date of Patent: Dec. 10, 2002

(54) TABLE LEG CABLE MANAGEMENT SYSTEM

(75) Inventors: Loren L. Isensee, Chatfield, MN (US); Joseph S. Bettin, Preston, MN (US)

(73) Assignee: Valley Design Enterprises, Incorporated, Fountain, MN (US)

( * ) Notice: Subject to any disclaimer, the term of this patent is extended or adjusted under 35 U.S.C. 154(b) by 49 days.

(21) Appl. No.: 09/777,068

(22) Filed: Feb. 5, 2001

(65) Prior Publication Data

US 2002/0104464 A1 Aug. 8, 2002

(51) Int. Cl.[7] ..... A47B 3/00

(52) U.S. Cl. ..... 108/50.02; 312/223.6; 248/188.8

(58) Field of Search ..... 108/50.02, 50.01, 108/190; 312/223.6, 223.3, 223.1; 248/49, 188, 188.1, 188.8; 52/220.7, 220.1

(56) References Cited

U.S. PATENT DOCUMENTS

| | | | | |
|---|---|---|---|---|
| 4,163,867 A | * | 8/1979 | Breidenbach | 312/223.6 X |
| 4,296,981 A | | 10/1981 | Hildebrandt et al. | |
| 4,535,703 A | | 8/1985 | Henriott et al. | |
| 4,627,364 A | * | 12/1986 | Klein et al. | 312/223.6 X |
| 5,237,935 A | | 8/1993 | Newhouse et al. | |
| 5,357,874 A | | 10/1994 | Palmer | |
| 5,638,759 A | * | 6/1997 | Klugkist | 312/223.6 X |
| 5,715,761 A | | 2/1998 | Frattini | |
| 5,718,179 A | * | 2/1998 | Johnson et al. | 108/50.02 X |
| 5,934,203 A | * | 8/1999 | Glass | 108/50.02 X |
| 6,003,447 A | * | 12/1999 | Cox et al. | 108/50.02 |
| 6,086,028 A | | 7/2000 | Pfister | |

FOREIGN PATENT DOCUMENTS

| | | | | |
|---|---|---|---|---|
| EP | 0462920 A1 | * | 12/1991 | 312/223.6 |

* cited by examiner

*Primary Examiner*—Jose V. Chen
*Assistant Examiner*—Hanh V. Tran
(74) *Attorney, Agent, or Firm*—Kinney & Lange, P.A.

(57) ABSTRACT

A support member for use with an article of furniture has cable management capabilities. The support member comprises an elongate leg member defined by a wall to form an elongate inner cavity therein. Preferably, the leg member has a substantially circular lateral cross-section. The wall has a slot therethrough providing access to the inner cavity. The slot has first and second ends where each end of the slot is spaced from its respective end of the elongate leg member. An access panel is hingedly attached to the support member to cover only an intermediate portion of the slot. The access panel is moveable between a closed position and an open position. In the closed position, the access panel limits access to the inner cavity through the intermediate portion of the slot. In the open position the access panel allows access to the inner cavity along the entire length of the slot.

12 Claims, 6 Drawing Sheets

TABLE LEG CABLE MANAGEMENT SYSTEM

BACKGROUND OF THE INVENTION

This invention relates to an article of furniture which utilizes a support member having wire management capabilities, and more particularly to a table leg having a cable management system whereby cables or wires may be concealed and contained within the table leg.

As the number of work related devices requiring wires, cables, and electrical cords become more prevalent, the need for managing cable and wiring becomes more important. This increase of electrical, communication and computer equipment requires its associated support furniture to be located near electrical and communication outlets. One major problem associated with numerous wires, cables and electrical cords is the unsightly and cluttered view of tangled wires and cables. A disorganized and unsightly article of furniture is not only aesthetically unpleasing but also creates a disorganized and chaotic work area which decreases work production. In addition, tangled cables and wires present a safety hazard under and around equipment and its associated furniture either by tripping or from electric shock. Further, if a person accidently dislodges an exposed cable, it may compromise the data integrity being carried by that cable, or damage the equipment or the cable itself. Thus, there exists a need to safely and orderly manage wires, cables and cords by organizing and concealing them within an article of furniture to address these types of issues.

Articles of furniture having wire management capabilities are known in the art. The articles include a variety of table or desk legs having open channels in which to run electrical or communication wires. One problem associated with the prior art is that the wires are often threaded through an opening on the desk or table top and then through the leg in order to reach the floor. See, e.g., U.S. Pat. No. 5,237,935 to Newhouse, U.S. Pat. No. 4,296,981 to Hildebrandt and U.S. Pat. No. 5,715,761 to Frattini. These prior art patents disclose cable management systems that are both complicated and cumbersome to use as equipment is continually updated or removed from the article of furniture. Other prior art patents disclose channel assemblies for wire management in a table leg, which show the wire being threaded through a channel which extends the entire length of the table leg. For example, in U.S. Pat. No. 5,357,874 to Palmer, cable extends out of openings at both the upper and lower ends of a leg assembly, and in U.S. Pat. No. 6,086,028 to Pfister, cable exits a channel in a leg at both an upper access opening and lower access opening. While Pfister does provide a spring biased door to allow access to a cable channel in a leg, the door biasing arrangement is awkward to manipulate in use, which can be especially troublesome when the person seeking access to the cavity is working underneath a table or within some other confined and relatively inaccessible area.

BRIEF SUMMARY OF THE INVENTION

The present invention is a support member for use with an article of furniture which has cable management capabilities. The support member, such as a leg member, is elongate with a substantially circular lateral cross-section. The leg member is defined by a wall to form an elongate inner cavity therein. The wall has a slot therethrough providing access to the inner cavity. The slot has first and second ends where each end of the slot is spaced from its respective end of the elongate leg member. An access panel is hingedly attached to the support member to cover only an intermediate portion of the slot. The access panel is moveable between a closed position and an open position. In the closed position, the access panel limits access to the inner cavity through the intermediate portion of the slot. In the closed position, the respective ends of the access panel and the slot collectively define a lateral opening into the inner cavity at each end of the slot. The access panel is spring biased to the closed position. The access panel is movable to the open position by pushing the access panel inward which allows access to the inner cavity through the slot. Once access is provided to the inner cavity, cable may be placed within the inner cavity to be contained and concealed within the leg member.

BRIEF DESCRIPTION OF THE DRAWINGS

The present invention will be further explained with reference to the attached figures, wherein like structure is referred to by like numerals throughout the several views.

While the above-identified drawing figures set forth one preferred embodiment of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION

Figure 1:
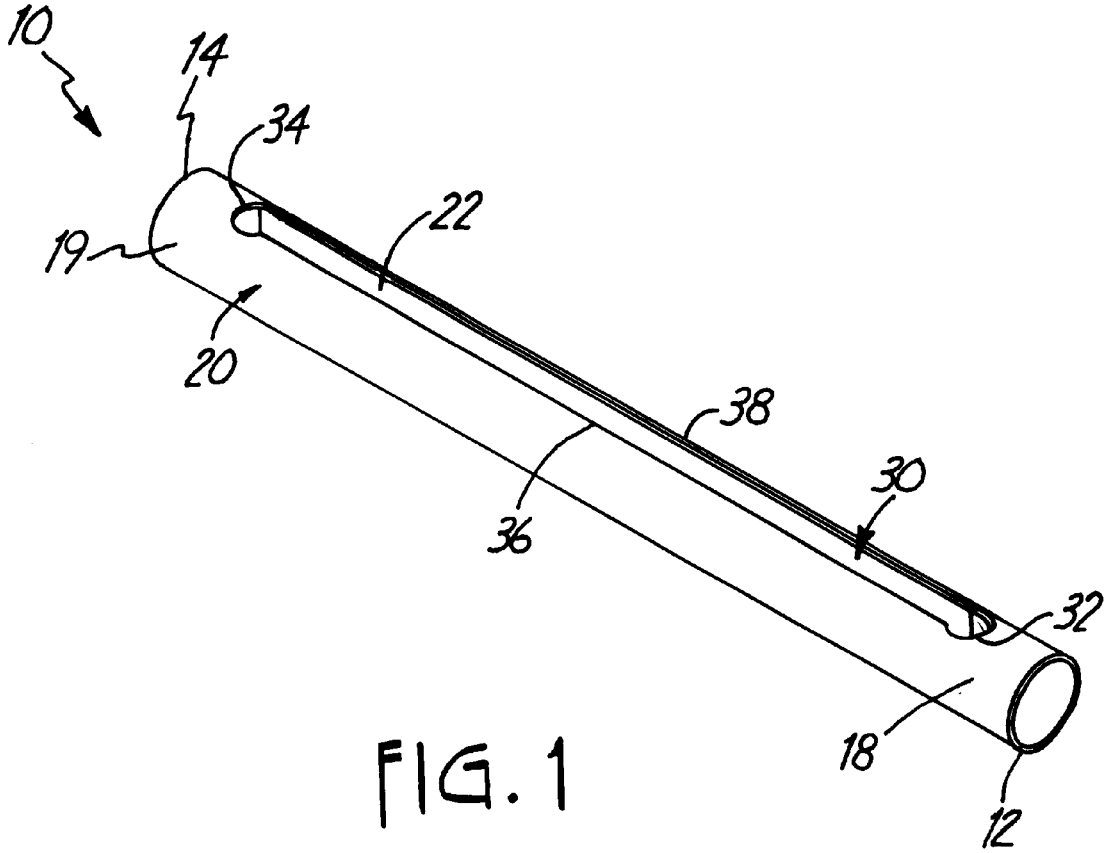
FIG. 1 is a perspective view of a support member of the present invention with the access panel thereof not shown in order to show the inner cavity.

Referring now to the drawings and particular to FIG. 1, there is shown a support member 10 having wire management capabilities. The support member 10 is for use as an article of furniture, such as a table leg member or other support member. The support member 10 is defined by a support wall 20, which has an inner cavity 22 therein.

Figure 2:
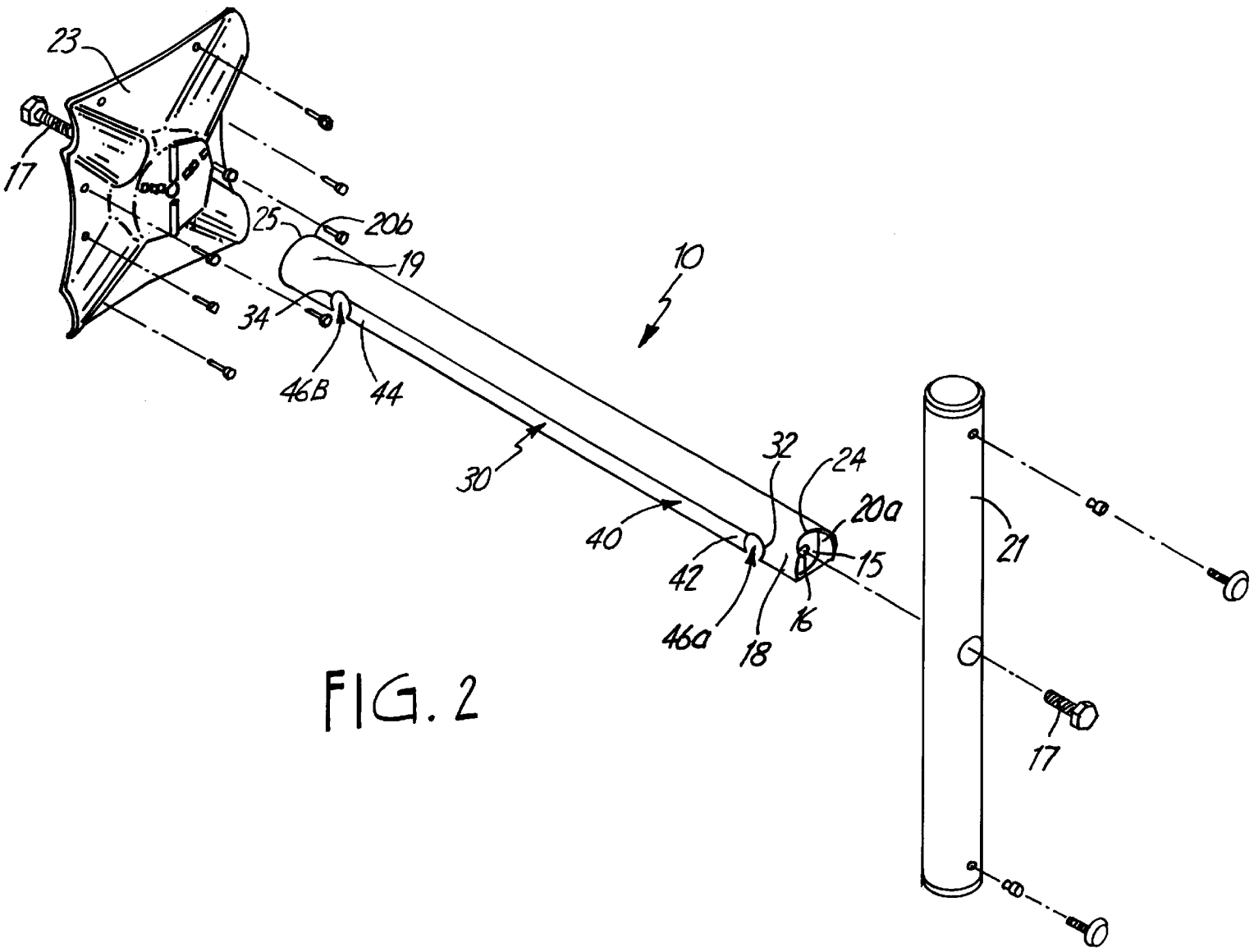
FIG. 2 is a perspective exploded view of invention and related support components with the access panel in place.
Figure 3:
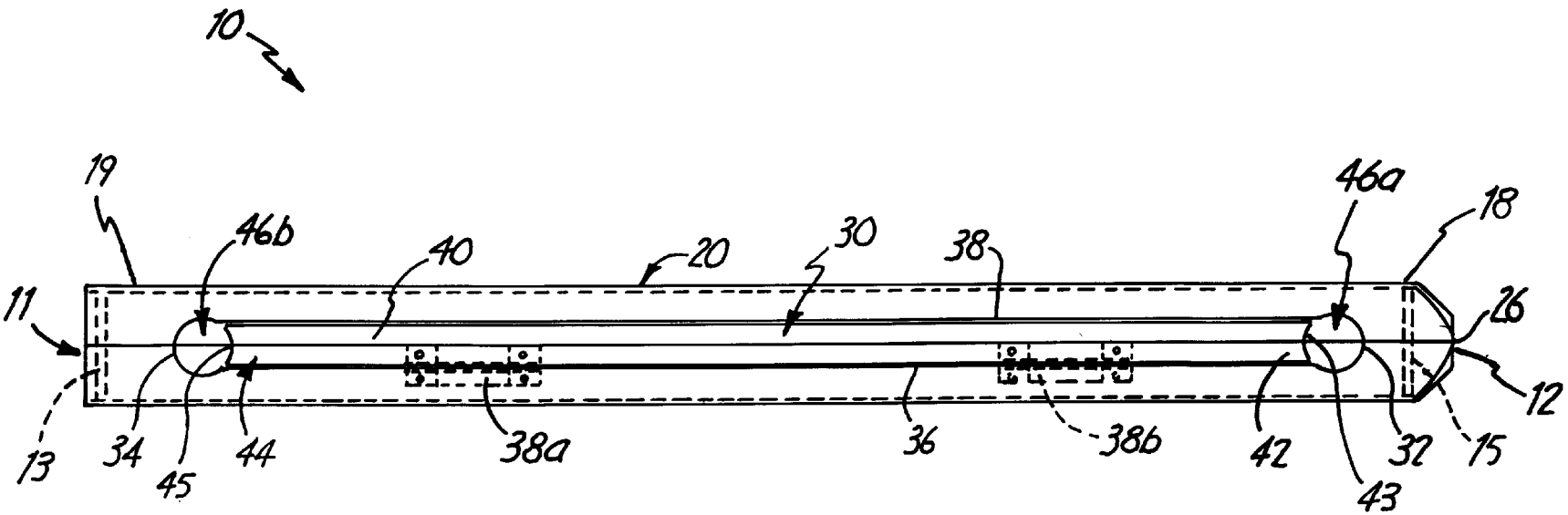
FIG. 3 is a plan view of the support member showing the hinged access panel.
Figure 4:
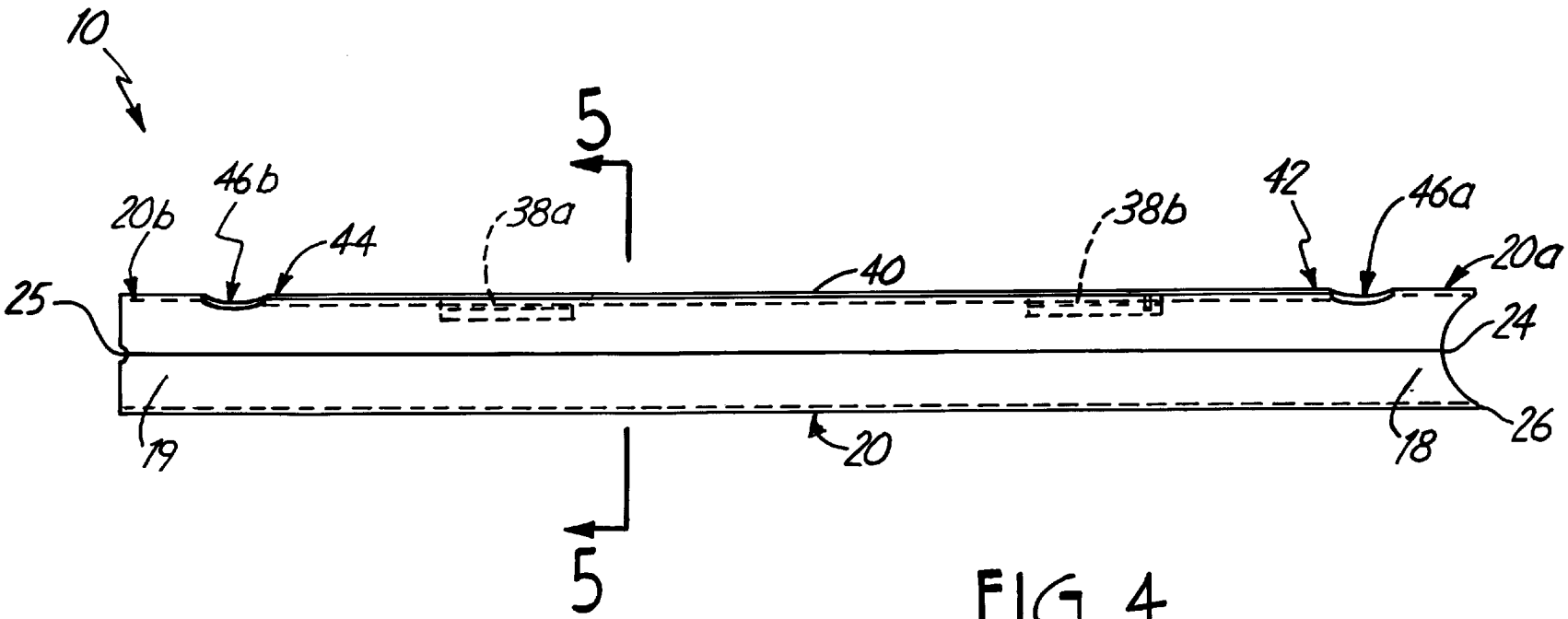
FIG. 4 is a side view of the support member showing the hinged access panel.

The support member 10 formed by the support wall 20 is preferably an elongate member with a substantially circular lateral cross-sectional area. In optional embodiments, the lateral cross-sectional area of the support wall 20 could be of any suitable shape, such as a substantially square shape or substantially triangularly shape. The support member 10 has a first end 12 and a second end 14. The support member 10 has generally tubular segments 18, 19 adjacent the first and second ends 12, 14 thereof. As shown in FIGS. 2 and 3, located within the tubular segments 18, 19 are first and second end plates 13, 15, respectively. The first and second end plates 13, 15 each have a hole 16 therein for securing a fastener 17, such as a bolt, thereto. In a preferred embodiment, the first and second end plates 13, 15 are positioned within the tubular segments 18, 19, resulting in the support wall 20 extending past the end plates 13, 15 forming support wall extensions 20*a*, 20*b* at each end, as shown in FIGS. 2, 3 and 4. The support wall extensions 20*a*,

20*b* have cutouts 24, 25 formed into the extensions to allow engagement with other members, such as a furniture support members 21 and 23. As can be seen in FIG. 2, each support wall extension 20*a*, 20*b* has cutouts 24, 25 that diametrically oppose each other at their respective support member end. Preferably, the cutouts 24, 25 are at least arcuate or substantially semi-circular shaped cutouts formed into the support wall extensions 20*a*, 20*b*. As shown in FIG. 2, the support wall extension 20*a* has cutouts 24 with a larger radius of curvature than the cutouts 25 of the support wall extension 20*b*. The larger cutouts 24 of the first end 12 enable the support member 10 to accept the shape of a larger furniture support member 21 within the cutouts 24. The cutouts 24 in the support wall extension 20*a* leave a substantial flat surface 26 on the support wall extension 20*a*. In optional embodiments, the cutouts 24, 25 could be formed of any shape. In another embodiment, a plurality of cutouts could be provided in each support member end 12, 14.

The support wall 20 has a slot 30 extending through the support wall 20 providing access to the inner cavity 22. As shown in FIG. 3, the slot 30 has a length less than a full length of the inner cavity 22 and is preferably elongate. The slot 30 has a first end 32 and a second end 34. As shown in FIGS. 1 and 3, the slot 30 has first and second side edges 36, 38 extending between the first and second ends of the slot 32, 34. The slot first end 32 is spaced from the support member first end 12. The generally tubular segment 18 represents the amount of spacing between ends 12 and 32. Similarly, the slot second end 34 is spaced from the support member second end 14. The generally tubular segment 19 represents the amount of spacing between ends 14 and 34. With the slot first and second ends 32, 34 being spaced from its respective support member ends 12, 14, the slot 30 provides access to an intermediate portion of the inner cavity 22. Thus, the slot 30 does not provide access to the entire length of the inner cavity 22. As shown in FIG. 3, the space between the slot first end 32 and the support member first end 12 is approximately the same longitudinal length as the space between the slot second end 34 and the support member second end 14. In an optional embodiment, the space between the slot first end 32 and the support member first end 32 is a different longitudinal length than the space between the slot second end 34 and the support member second end 14. In another optional embodiment, the support wall has a plurality of slots having a length less than the full length of the inner cavity 22 which provide access to the inner cavity 22.

An access panel 40 is attached to the support member 10 to prevent unintended access to the inner cavity 22. The access panel 40 is moveable between a closed position and an open position. In its closed position, the access panel 40 covers only an intermediate portion of the slot thereby concealing (behind the access panel 40) the inner cavity 22 and anything (e.g., cables) contained in the inner cavity 22. The access panel 40 in its open position allows access to the inner cavity 22. The access panel 40 can be attached to either the first side edge 36 or second side edge 38 of the slot 30. In a preferred embodiment, the access panel 40 is hingedly attached to the support member along the first side edge 36 of the slot 30.

Figure 5:
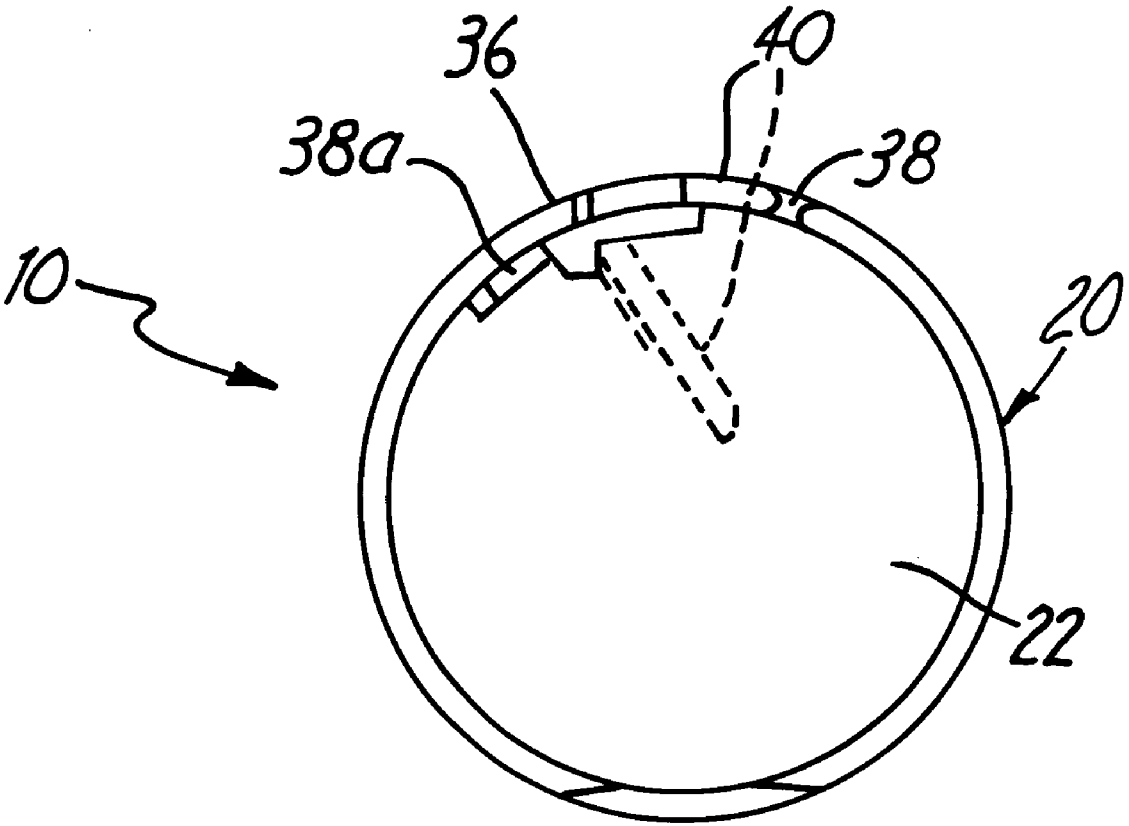
FIG. 5 is a sectional view as taken along lines 5—5 in FIG. 4.
Figure 6:
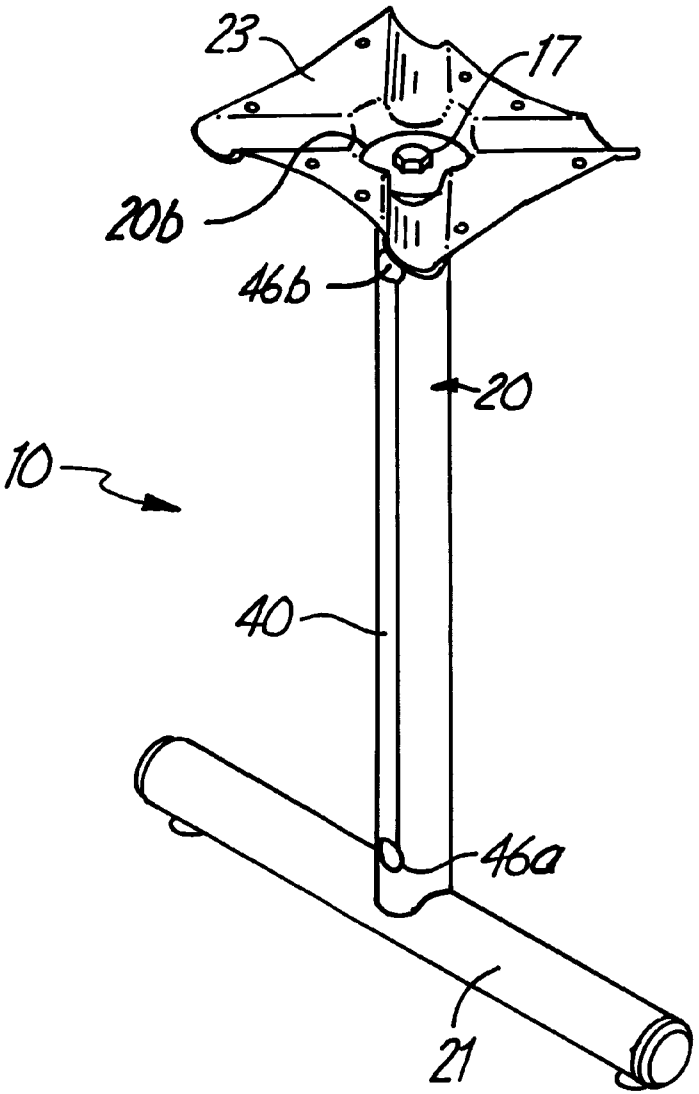
FIG. 6 is a perspective view of the invention as a table leg ready for incorporation into an article of furniture.

As shown in FIGS. 3–5, the access panel 40 is hingedly attached to the first side edge 36 using first and second spring hinges 38*a*, 38*b*. Each spring hinge 38*a*, 38*b* is attached to an inner side of the support wall 20 (in the inner cavity 22) along the first side edge 36. Thus, the first and second spring hinges 38*a*, 38*b* are not visible from the outside of the support member 10, as shown in FIG. 5.

The access panel 40 has first and second ends 42, 44. When the access panel 40 is in the closed position, the first and second ends 42, 44 of the access panel 40 together with their respective first and second slot ends 32, 34 collectively define lateral openings 46*a*, 46*b* respectively, into the inner cavity 22 at each end of the slot 30. When the access panel 40 is in its closed position, the cavity 22 can be readily accessed through the lateral openings 46*a* and 46*b*. When the access panel 40 is in its open position, access to the inner cavity 22 along the entire length of the slot 30 is permitted.

As shown in FIGS. 1–4, the slot ends 32, 34 are arcuate. As shown in FIG. 3, the first and second ends 42, 44 of the access panel 40 have arcuate or substantially semi-circular cutouts 43, 45 into the first and second ends 42, 44 of the access panel 40. Thus, when the access panel 40 is in the closed position, the first and second ends 42, 44 of the access panel 40 together with their respective first and second slot ends 32, 34 form a circular lateral opening 46 at each end of the slot 30. Preferably, each lateral opening 46 has a larger circumferential dimension than the slot 30. The large radius openings 46*a*, 46*b* provide a smooth surface for cables to pass over as they enter/exit the cavity 22, and accommodate cable plugs or connectors, as well as making access to the cable easier to manage.

Preferably, the access panel 40 is spring biased to the closed position by one or both of the hinges 38*a*, 38*b*. The access panel 40 is moveable from the closed position to the open position by application of pressure on the access panel 40 directed toward the inner cavity 22 (radially inward pressure). The pressure on the access panel 40 swings the access panel 40 from a closed position to an open position about the hinges 38*a* and 38*b*. When the access panel 40 is moved from the closed position to the open position, the access panel swings inwardly into the inner cavity 22 away from the second side edge 38 of the slot 30 (as shown in phantom in FIG. 5). Once the application of pressure is terminated, the spring force provided by the first and second spring hinges 38*a*, 38*b* moves the access panel 40 from its open position back to its closed position.

In use, the access panel 40 is pushed inward and held open. The cable, wire or cord intended to be partially concealed within the support member 10 is placed inside the inner cavity 22. The access panel 40 is closed while one end of the cable extends out from one lateral opening 46*a* and the other end of the cable extends out of the other lateral opening 46*b*. The present invention thus provides an elegantly single means for covering and organizing cables in a furniture component, but allowing ready access thereto. The quick and convenient access to the cable cavity in a table leg of the present invention allows for an easier and more effective means to conceal electrical and communication wiring within a table leg than was previously available.

Although the present invention has been described with reference to preferred embodiments, workers skilled in the art will recognize that changes may be made in form and detail without departing from the spirit and scope of the invention.

What is claimed is:

1. A support member comprising:

a tubular member having a contiguous perimeter wall, the wall configured to have an elongate opening therethrough, the opening having a length extending less than that of the tubular member; and an access panel attached to the tubular member and moveable between a closed and an open position, wherein the access panel in the closed position covers only an intermediate portion of the elongate opening extending through the tubular member, and wherein the access panel in the open position allows access to the elongate opening extending through the tubular member.

2. The support member of claim 1 wherein the access panel is hingedly attached to the tubular member.

3. The support member of claim 1 wherein the access panel is spring biased toward the closed position.

4. A support member having cable management capabilities for use with an article of furniture comprising:

a tubular member having a contiguous perimeter wall which defines an inner longitudinal cavity, the wall configured to define an elongate opening extending therethrough for providing access to the inner cavity; and an access panel hingedly attached to the tubular member to cover only an intermediate portion of the elongate opening in a closed position for limiting access to the inner cavity through the elongate opening, with the access panel being moveable to an open position to provide access to the inner cavity through the elongate opening.

5. The support member of claim 4 wherein the access panel is spring biased and movable to the open position by application of pressure on the access panel directed toward the inner cavity.

6. The support member of claim 4 wherein the tubular member has a substantial circular lateral cross-sectional area.

7. A table leg for use with an article of furniture comprising:

a tubular leg member having first and second ends and having a substantially circular lateral cross-section defined by a contiguous wall to form an elongate inner cavity therein, the contiguous wall configured to define an elongate opening therethrough, the elongate opening having first and second ends and each end of the elongate opening being spaced from its respective end of the tubular leg member; and an access panel hingedly attached to the tubular leg member, the access panel being moveable between a closed position and an open position, the access panel being spring biased to the closed position whereby it covers an intermediate portion of the elongate opening, the access panel being movable to the open position by pushing the access panel inward which allows access to the inner cavity through the elongate opening.

8. The table leg of claim 7 wherein the elongate opening has first and second side edges extending between the first and second ends of the elongate opening, and the access panel is hingedly attached to the elongate leg member along the first side edge.

9. The table leg of claim 7 wherein access panel has first and second ends, and wherein the respective ends of the access panel and elongate opening collectively define a lateral opening into the inner cavity at each end of the elongate opening.

10. The table leg of claim 9 wherein each lateral opening is circular.

11. A table leg for use with an article of furniture comprising:

An elongate leg member having first and second ends and having a substantially circular lateral cross-section defined by a wall to form an elongate inner cavity therein, the wall having a slot therethrough, the slot having first and second ends and each end of the slot being spaced from its respective end of the elongate leg member; and an access panel hingedly attached to the elongate leg member, the access panel being moveable between a closed position and an open position, the access panel being spring biased to the closed position whereby it covers an intermediate portion of the slot, the access panel being movable to the open position by pushing the access panel inward which allows access to the inner cavity through the slot, wherein access panel has first and second ends, wherein the respective ends of the access panel and slot collectively define a lateral opening into the inner cavity at each end of the slot, and wherein each lateral opening has a larger circumferential dimension than the slot.

12. The table leg of claim 8 wherein the access panel swings inwardly into the inner cavity away from the second side edge of the elongate opening.

* * * * *